US009658588B2

(12) United States Patent
Tomita et al.

(10) Patent No.: US 9,658,588 B2
(45) Date of Patent: May 23, 2017

(54) IMAGE FORMING APPARATUS, IMAGE ADJUSTMENT METHOD FOR THE IMAGE FORMING APPARATUS, AND ADJUSTMENT PATTERN IMAGE

(71) Applicant: Sharp Kabushiki Kaisha, Osaka-shi, Osaka (JP)

(72) Inventors: Norio Tomita, Osaka (JP); Yoshikazu Harada, Osaka (JP); Yuji Kumagai, Osaka (JP); Masaki Amemiya, Osaka (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 14/293,009

(22) Filed: Jun. 2, 2014

(65) Prior Publication Data

US 2014/0363177 A1 Dec. 11, 2014

(30) Foreign Application Priority Data

Jun. 5, 2013 (JP) ..... 2013-118987

(51) Int. Cl.
*G03G 15/00* (2006.01)
*G03G 15/23* (2006.01)

(52) U.S. Cl.
CPC ..... *G03G 15/5062* (2013.01); *G03G 15/234* (2013.01); *G03G 2215/00569* (2013.01); *G03G 2215/0132* (2013.01)

(58) Field of Classification Search
CPC ..... G03G 15/5062; G03G 15/234; G03G 2215/0132; G03G 2215/00569
USPC ..... 399/15, 66, 301
See application file for complete search history.

(56) References Cited

U.S. PATENT DOCUMENTS

2005/0100370 A1 5/2005 Van Den Berg et al.
2006/0177246 A1* 8/2006 Kawada et al. ..... 399/301
2007/0189789 A1* 8/2007 Suzuki ..... G03G 15/5062 399/49
2011/0076045 A1* 3/2011 Sobue ..... G03G 15/5062 399/81

FOREIGN PATENT DOCUMENTS

JP 2005-148736 A 6/2005
JP 2005-321594 A 11/2005
(Continued)

*Primary Examiner* — Walter L Lindsay, Jr.
*Assistant Examiner* — Jessica L Eley
(74) *Attorney, Agent, or Firm* — Keating & Bennett, LLP

(57) ABSTRACT

A set of adjustment pattern images includes first adjustment pattern images and second adjustment pattern images to be formed on a first side and a second side of a recording sheet, respectively, by an image forming apparatus. The set of adjustment pattern images is employed to adjust an image forming position by the image forming apparatus such that an image forming position of the first adjustment pattern images is aligned with an image forming position of the second adjustment pattern images. The set of adjustment pattern images includes at least two first adjustment pattern images that are spaced from each other and at least two second adjustment pattern images that are spaced from each other, and the first adjustment pattern images on the first side and the second adjustment pattern images on the second side are arranged alternately with each other.

12 Claims, 9 Drawing Sheets

(56) References Cited

FOREIGN PATENT DOCUMENTS

| | | | |
|---|---|---|---|
| JP | 2006-72075 | A | 3/2006 |
| JP | 2008-8967 | A | 1/2008 |
| JP | 2008-275991 | A | 11/2008 |
| JP | 2009-104058 | A | 5/2009 |

* cited by examiner

IMAGE FORMING APPARATUS, IMAGE ADJUSTMENT METHOD FOR THE IMAGE FORMING APPARATUS, AND ADJUSTMENT PATTERN IMAGE

CROSS-REFERENCE TO RELATED APPLICATIONS

The present application claims priority under 35 U.S.C. §119(a) to Japanese Patent Application No. 2013-118987, filed on Jun. 5, 2013. The contents of this application are incorporated herein by reference in its entirety.

FIELD OF THE INVENTION

The present invention relates to a set of adjustment pattern images, an image forming apparatus, and an image adjustment method, for adjusting an image forming position by the image forming apparatus by forming the adjustment pattern images on a recording sheet by the image forming apparatus.

CONVENTIONAL ART

For adjustment of an image forming position, there has been known an image forming apparatus which forms an adjustment pattern image on a recording sheet such as a sheet of recording paper and which adjusts an image forming position based on the adjustment pattern image.

To adjust an image forming position, such conventional image forming apparatuses may form an adjustment pattern image only on a first side (a front side) of the recording sheet. In addition, some conventional image forming apparatuses, particularly those which effect duplex printing on both sides of the recording sheet, may form adjustment pattern images not only on the first side (the front side) but also on the second side (the back side) of the recording sheet.

For example, Patent Document 1 discloses an image forming apparatus which forms adjustment pattern images on both sides of a recording sheet (specifically, a sheet of recording paper) and which enables a user to find out the amount of relative misalignment in the print positions and the enlargement/reduction ratio of the images precisely and easily, without using a measuring instrument. For example, Patent Document 1 discloses a set of adjustment pattern images PX1, PX2 as shown in FIGS. 9(*a*) and 9(*b*).

FIGS. 9(*a*) and 9(*b*) are plan views showing an example of a set of conventional adjustment pattern images PX1, PX2 as disclosed in Patent Document 1. FIG. 9(*a*) shows adjustment pattern images PX1 formed on one side (a first side P1) of a recording sheet P. FIG. 9(*b*) shows adjustment pattern images PX2 formed on the other side (a second side P2) of the recording sheet P.

The adjustment pattern images PX1, PX2 shown in FIGS. 9(*a*) and 9(*b*) are the same images composed of unbroken straight lines, and are formed on the first side P1 and the second side P2 of the recording sheet P, respectively.

[Patent Document 1] JP 2005-321594 A

SUMMARY OF THE INVENTION

Using the set of conventional adjustment pattern images PX1, PX2 as shown in FIG. 9, image adjustment for the image forming apparatus is performed, for example, in the following manner. An operator such as a serviceman or a user sees through the recording sheet P on which the adjustment pattern images PX1, PX2 are formed, from either the first side P1 or the second side P2, with the recording sheet P being held to the light. In this state, the operator visually checks how much the adjustment pattern images PX1, PX2 on the first side P1 and the second side P2 are out of alignment. Alternatively, a detection device using an image reading sensor or the like may be employed to detect, from either the first side P1 or the second side P2, how much the adjustment pattern images PX1, PX2 on the first side P1 and the second side P2 are out of alignment. However, a problem in this conventional technique arises from the fact that the adjustment pattern images PX1, PX2 are arranged as unbroken straight lines. Namely, the operator cannot precisely find out, or the detection device cannot precisely detect, a slight misalignment between the adjustment pattern images PX1 on the first side P1 and the adjustment pattern images PX2 on the second side P2.

In view of this problem, the present invention focuses on an image adjustment technique in the image forming apparatus using a set of adjustment pattern images. An object of the present invention is to provide a set of adjustment pattern images, an image forming apparatus, and an image adjustment method for the image forming apparatus, which enables an operator to precisely find out a slight misalignment between the adjustment pattern images on the first side and the adjustment pattern images on the second side, or enables a detection device to precisely detect the same.

In order to solve the above-mentioned problem, the present invention provides a set of adjustment pattern images, an image forming apparatus, and an image adjustment method for the image forming apparatus, as described below.

(1) Adjustment Pattern Images

A set of adjustment pattern images according to the present invention has following characteristics. The set of adjustment pattern images is formed by an image forming apparatus, and includes first adjustment pattern images to be formed on one side, or a first side, of a recording sheet and second adjustment pattern images to be formed on another side, or a second side, of the recording sheet. The set of adjustment pattern images is employed to adjust an image forming position by the image forming apparatus such that an image forming position of the first adjustment pattern images on the first side is aligned with an image forming position of the second adjustment pattern images on the second side. The set of adjustment pattern images includes at least two first adjustment pattern images that are spaced from each other and at least two second adjustment pattern images that are spaced from each other, and the first adjustment pattern images on the first side and the second adjustment pattern images on the second side are arranged alternately with each other.

(2) Image Forming Apparatus

An image forming apparatus according to the present invention has following characteristics. The image forming apparatus is configured to form the set of adjustment pattern images according to the present invention on a recording sheet and to adjust an image forming position based on the set of adjustment pattern images. The image forming apparatus includes an image forming section for forming an image on the recording sheet, a reverse conveyance path for reversing the recording sheet on which an image is formed by the image forming section on the one side, or the first side, of the recording sheet and for guiding the recording sheet to the image forming section so as to form an image on the other side, or the second side, of the recording sheet, and an adjustment pattern image output mode in which the first adjustment pattern images and the second adjustment pattern images in the set of adjustment pattern images are formed on the first side and the second side of the recording sheet, respectively, by means of the image forming section and the reverse conveyance path.

(3) Image Adjustment Method for the Image Forming Apparatus

An image adjustment method according to the present invention is an image adjustment method for an image forming apparatus which forms an image on a recording sheet by writing the image based on an adjustment value entered by an input operation in an operation section or an adjustment value detected by a detection device. The image adjustment method is characterized by an image forming step of forming the set of adjustment pattern images according to the present invention on the first side and the second side of the recording sheet, a measurement step of measuring the adjustment pattern images formed on the recording sheet in the image forming step, an adjustment value input step of inputting the adjustment value in the operation section, based on a value measured in the measurement step, and an image writing step of determining an image writing timing by the image forming apparatus, based on the adjustment value inputted in the adjustment value input step.

As an illustrative embodiment of the present invention, both of the first adjustment pattern images and the second adjustment pattern images may be arranged in a broken linear pattern.

As an illustrative embodiment of the present invention, the first adjustment pattern images and the second adjustment pattern images may be arranged as broken straight lines made of a plurality of dots or lines.

As an illustrative embodiment of the present invention, first measurement images may be formed on each side of either the first adjustment pattern images or the second adjustment pattern images. The first measurement images are spaced from each other in an orthogonal direction that is orthogonal to a direction of the broken straight lines, by a predetermined first interval with reference to the associated adjustment pattern images. Second measurement images may be formed on each side of the others of the first adjustment pattern images or the second adjustment pattern images along which the first measurement images are not formed. The second measurement images are spaced from each other in the orthogonal direction by a second interval with reference to the other associated adjustment pattern images. The second interval is obtained by adding a predetermined value to the first interval.

As an illustrative embodiment of the present invention, the first adjustment pattern images may be separated from each other by a first predetermined distance, and the second adjustment pattern images may be separated from each other by a second predetermined distance.

As an illustrative embodiment of the present invention, at least two of the first adjustment pattern images and at least two of the second adjustment pattern images may be formed in a sheet conveying direction, and at least two of the first adjustment pattern images and at least two of the second adjustment pattern images may be formed in a width direction of the recording sheet, the width direction being orthogonal to the sheet conveying direction.

As an illustrative embodiment of the present invention, the first adjustment pattern images and the second adjustment pattern images may be identical to each other, with either the former or the latter being rotated 180 degrees about a center of the recording sheet in plan view.

As an illustrative embodiment of the present invention, the first adjustment pattern images and the second adjustment pattern images may be formed in different colors.

According to the present invention, when image adjustment for the image forming apparatus is performed with use of the set of adjustment pattern images, an operator can precisely find out, or a detection device can precisely detect, a slight misalignment between the adjustment pattern images on the first side and the adjustment pattern images on the second side.

BRIEF DESCRIPTION OF THE DRAWINGS

FIG. 9(*b*) is a plan view showing an example of a set of conventional adjustment pattern images as disclosed in Patent Document 1, specifically showing adjustment pattern images formed on the other side (a second side) of a recording sheet.

MODE FOR CARRYING OUT THE INVENTION

Embodiments according to the present invention are hereinafter described with reference to the drawings.

(Image Forming Apparatus)

Figure 1:
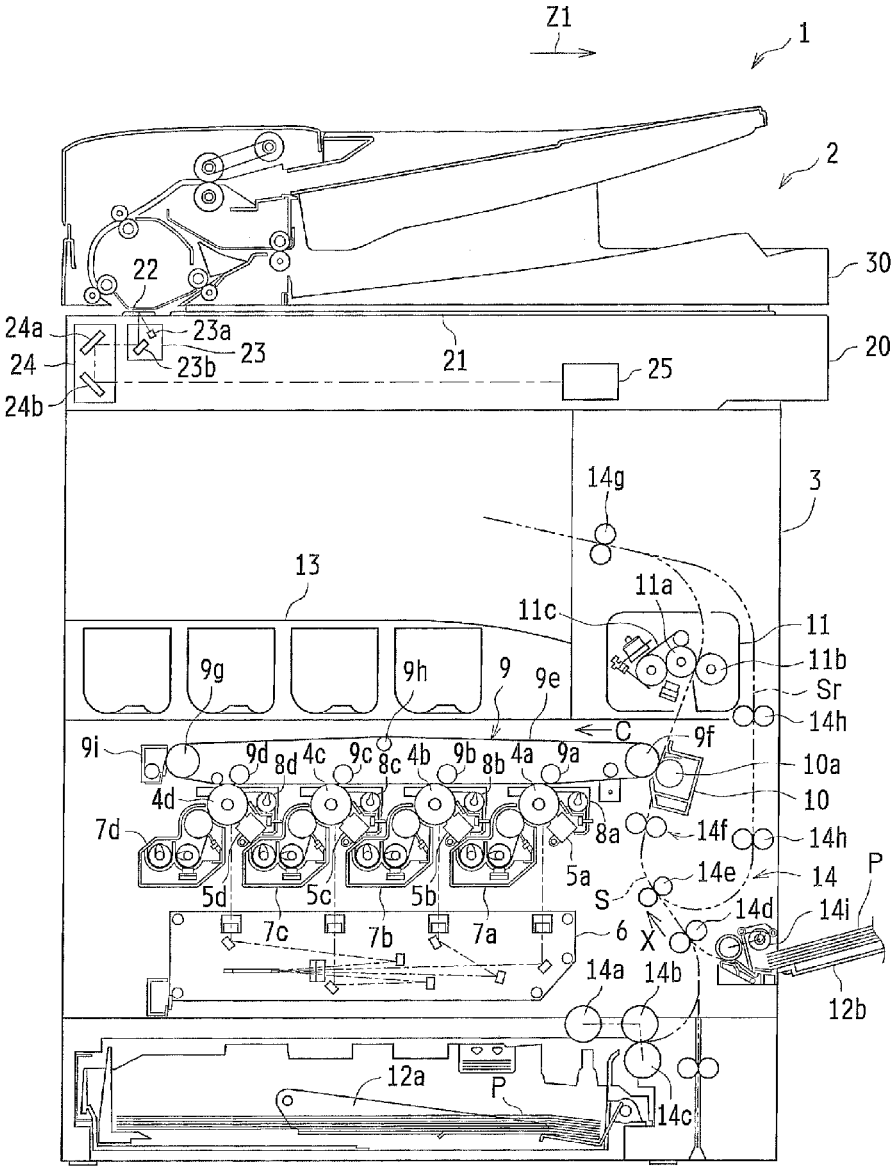
FIG. 1 is a front view showing a schematic configuration of an image forming apparatus which forms a set of adjustment pattern images according to the embodiments of the present invention.

FIG. 1 is a front view showing a schematic configuration of an image forming apparatus which forms a set of adjustment pattern images according to the embodiments of the present invention.

An image forming apparatus 1 is a multifunction device which serves, for example, as a scanner, a facsimile, and a printer. The image forming apparatus 1 includes an image reading device 2 for reading an image on an original copy, and an image forming unit 3 for forming an image on a recording sheet P.

The image reading device 2 includes an image reading unit 20, and a document feeder 30 which is attached to the image reading unit 20 in an openable and closable manner.

The image reading unit 20 is configured to read an image on a stationary original and an image on a moving original. The image reading unit 20 is equipped with a platen glass 21, an original reading glass 22, a light source unit 23, a mirror unit 24, and an imaging unit 25.

When the image reading unit 20 reads an image on a stationary original, light is emitted from a light source 23*a* while the light source unit 23 and the mirror unit 24 are moved in a transport direction Z1. The light emitted from the light source 23*a* irradiates, through the platen glass 21, an original copy placed on the platen glass 21. The light reflected by the original copy is incident on the imaging unit 25 via the platen glass 21, a mirror 23*b* in the light source unit 23, and mirrors 24*a* and 24*b* in the mirror unit 24. In this manner, the image reading unit 20 can read an image on a stationary original copy which is placed on the platen glass 21.

When the image reading unit 20 reads an image on a moving original, light is emitted from the light source 23*a* while the light source unit 23 is stopped at a reading position (the position shown in FIG. 1). The light emitted from the light source 23*a* irradiates, through the original reading glass 22, an original copy which is transported on the original reading glass 22 in the transport direction Z1 by the document feeder 30. The light reflected by the original copy is incident on the imaging unit 25 via the original reading glass 22, the mirror 23*b* in the light source unit 23, and the mirrors 24*a* and 24*b* in the mirror unit 24. In this manner, the image reading unit 20 can read an image on the moving original copy which is transported on the original reading glass 22 by the document feeder 30.

The image forming unit 3 is equipped with photosensitive drums 4*a*, 4*b*, 4*c*, 4*d*, chargers 5*a*, 5*b*, 5*c*, 5*d*, an exposure device 6, developing devices 7*a*, 7*b*, 7*c*, 7*d*, cleaners 8*a*, 8*b*, 8*c*, 8*d*, an intermediate transfer belt device 9 having intermediate transfer rollers 9*a*, 9*b*, 9*c*, 9*d*, secondary transfer device 10, a fixing device 11, a paper feed tray 12*a* and a manual feed tray 12*b* as sheet accommodation units, a discharge tray 13 as a discharging unit, and a sheet conveying device 14.

The image forming unit 3 forms an image on a recording sheet P that is conveyed in a sheet conveying direction X, based on image data read by the image reading device 2 or based on data on a set of adjustment pattern images PT (see FIG. 3 and FIG. 4) stored in advance in a memory unit 102 to be describe later (see FIG. 2). The image forming unit 3 is configured to form a color image composed of black (K), cyan (C), magenta (M), and yellow (Y) as well as a monochrome image composed of a single color (for example, black).

Specifically, in this image forming unit 3, an imaging station for black images is constituted with a photosensitive drum 4*a*, a charger 5*a*, a developing device 7*a*, a cleaner 8*a*, and an intermediate transfer roller 9*a*. An imaging station for cyan images is constituted with a photosensitive drum 4*b*, a charger 5*b*, a developing device 7*b*, a cleaner 8*b*, and an intermediate transfer roller 9*b*. An imaging station for magenta images is constituted with a photosensitive drum 4*c*, a charger 5*c*, a developing device 7*c*, a cleaner 8*c*, and an intermediate transfer roller 9*c*. An imaging station for yellow images is constituted with a photosensitive drum 4*d*, a charger 5*d*, a developing device 7*d*, a cleaner 8*d*, and an intermediate transfer roller 9*d*.

The photosensitive drums 4*a*, 4*b*, 4*c*, 4*d* have a photosensitive layer on their surfaces. The chargers 5*a*, 5*b*, 5*c*, 5*d* apply a high voltage so as to charge the surfaces of the photosensitive drums 4*a*, 4*b*, 4*c*, 4*d* uniformly to a predetermined potential.

The exposure device 6 is a laser scanning unit which includes, for example, a laser diode and a reflection mirror. The exposure device 6 exposes the surfaces of the uniformly charged photosensitive drums 4*a*, 4*b*, 4*c*, 4*d* according to the image data, and forms electrostatic latent images corresponding to the image data on the surfaces of the photosensitive drums. In this manner, the exposure device 6 can write electrostatic latent images on the surfaces of the photosensitive drums 4*a*, 4*b*, 4*c*, 4*d*, at a predetermined writing timing under the command of a control section 100 to be described later (see FIG. 2).

The developing devices 7*a*, 7*b*, 7*c*, 7*d* develop the electrostatic latent images formed on the photosensitive drums 4*a*, 4*b*, 4*c*, 4*d* by CMYK toners. After the development and the image transfer, some toner may not be transferred to the recording sheet P and may remain on the surfaces of the photosensitive drums 4*a*, 4*b*, 4*c*, 4*d*. The residual toner is removed and collected by the cleaners 8*a*, 8*b*, 8*c*, 8*d*.

The intermediate transfer belt device 9 is provided over the photosensitive drums 4*a*, 4*b*, 4*c*, 4*d*, and is equipped with an endless intermediate transfer belt 9*e*, an intermediate transfer belt driving roller 9*f*, an idler roller 9*g*, a tension roller 9*h*, and an intermediate transfer belt cleaner 9*i*. The intermediate transfer belt 9*e* is supported in a stretched fashion and moved in a circulating direction C by the intermediate transfer rollers 9*a*, 9*b*, 9*c*, 9*d*, the intermediate transfer belt driving roller 9*f*, the idler roller 9*g*, and the tension roller 9*h*. The toner images on the surfaces of the photosensitive drums 4*a*, 4*b*, 4*c*, 4*d* are transferred one after another on the intermediate transfer belt 9*e*, thereby forming a color toner image (toner images in multiple colors).

The toner images are transferred from the photosensitive drums 4*a*, 4*b*, 4*c*, 4*d* to the intermediate transfer belt 9*e* by the intermediate transfer rollers 9*a*, 9*b*, 9*c*, 9*d* which are pressed against the inner side (the back surface) of the intermediate transfer belt 9*e*. In order to transfer the toner images, a high-voltage transfer bias (the polarity of the high voltage is positive (+), opposite to the negative (−) charge polarity of the toner) is applied to the intermediate transfer rollers 9*a*, 9*b*, 9*c*, 9*d*.

The second transfer device 10 has a transfer roller 10*a* which is in contact with the intermediate transfer belt 9*e*. The transfer roller 10*a* is adjacent to the intermediate transfer belt driving roller 9*f* on the outer side of the intermediate transfer belt 9*e*. The intermediate transfer belt 9*e* and the transfer roller 10*a* are pressed against each other and thereby create a transfer nip region. In order to transfer the toner images in multiple colors from the intermediate transfer belt 9*e* to the recording sheet P, a voltage (for example, a high voltage in positive polarity (+), opposite to the negative (−) charge polarity of the toner) is applied to the transfer roller 10*a* of the secondary transfer device 10.

In the image forming apparatus 1, the toner images formed on the surfaces of the photosensitive drums 4*a*, 4*b*, 4*c*, 4*d* are superimposed on the intermediate transfer belt 9*e* to be a color toner image corresponding to the image data. The superimposed multi-color toner images are transported with the intermediate transfer belt 9*e* which moves in a circulating direction C, and are transferred on the recording sheet P by the transfer roller 10*a* of the secondary transfer device 10 which is adjacent to the intermediate transfer belt driving roller 9*f* on the outer side of the intermediate transfer belt 9*e*.

After the secondary transfer, the toner images on the intermediate transfer belt 9*e* may not be completely transferred on the recording sheet P by the secondary transfer device 10 and may remain on the intermediate transfer belt 9*e*. The residual toner is removed and collected by the intermediate transfer belt cleaner 9*i*. The intermediate transfer belt cleaner 9*i* is equipped with, for example, a cleaning blade which contacts the intermediate transfer belt 9*e* when pressed toward the idler roller 9*g* and which thereby removes and collects the residual toner.

The fixing device 11 includes a heating roller 11*a* and a pressure roller 11*b* between which a recording sheet P is transported in a sandwiched manner. The temperature of the heating roller 11*a* is controlled to a predetermined fixing temperature. The heating roller 11*a*, working with the pressure roller 11*b*, thermally compresses the recording sheet P at the fixing nip part, thereby melts, mixes, and pressure contacts the toner images transferred on the recording sheet P, and thermally fixes the toner images on the recording sheet P. The fixing device 11 is further equipped with an external heating belt 11*c* for externally heating the heating roller 11*a*.

The paper feed tray 12*a* is a tray for storing recording sheets P inside the image forming apparatus, and the manual feed tray 12*b* is a tray on which recording sheets P can be rested. The discharge tray 13 is a tray on which printed recording sheets P can be rested face down, when a relay conveyance unit 15 is removed.

The sheet conveying device 14 is provided with, from the paper feed tray 12*a* along the sheet conveyance path S, a pick-up roller 14*a*, a first separation roller 14*b*, a second separation roller 14*c*, conveyance rollers 14*d*, a pair of pre-registration rollers 14*e*, a pair of registration rollers 14*f*, and discharge rollers 14*g*. In addition, a pick-up roller 14*i* is provided in the vicinity of the manual feed tray 12*b*.

The recording sheet P on which the toner images have been transferred is conveyed while the toner images are being fixed on the recording sheet P by the heating roller 11*a* and the pressure roller 11*b*. The recording sheet P on which the toner images in multiple colors are fixed is discharged to the discharge tray 13 by the discharge rollers 14*g*.

Other than a color image, it is also possible to form a monochrome image by using at least one of the four imaging stations and to transfer the monochrome image on the intermediate transfer belt 9*e* of the intermediate transfer belt device 9. Just as the color image, the monochrome image is transferred from the intermediate transfer belt 9*e* to the recording sheet P and is fixed on the recording sheet P.

In the foregoing description, an image is formed on the first side P1 (the front side) of the recording sheet P. Additionally, an image can be formed on each side of the recording sheet P (duplex printing). In duplex printing, the recording sheet P is guided by conveyance rollers 14*h* into a reverse conveyance path Sr where the front side and the back side of the recording sheet P are reversed. The reversed recording sheet P is guided again to the pair of registration rollers 14*f*. The reverse conveyance path Sr as used herein is configured to reverse the front side and the back side of the recording sheet P after an image is formed on the first side P1 (the front side) by the image forming unit 3, and to guide the reversed recording sheet P to the image forming unit 3 so as to form an image on the second side P2 (the back side) of the recording sheet P.

During a normal image formation process in the image forming apparatus 1, an image read by the image reading device 2 is formed on a recording sheet P by the image forming unit 3. Then, the recording sheet P (the normal recording sheet) is discharged to the discharge tray 13, with a normal image being formed thereon.

Figure 2:
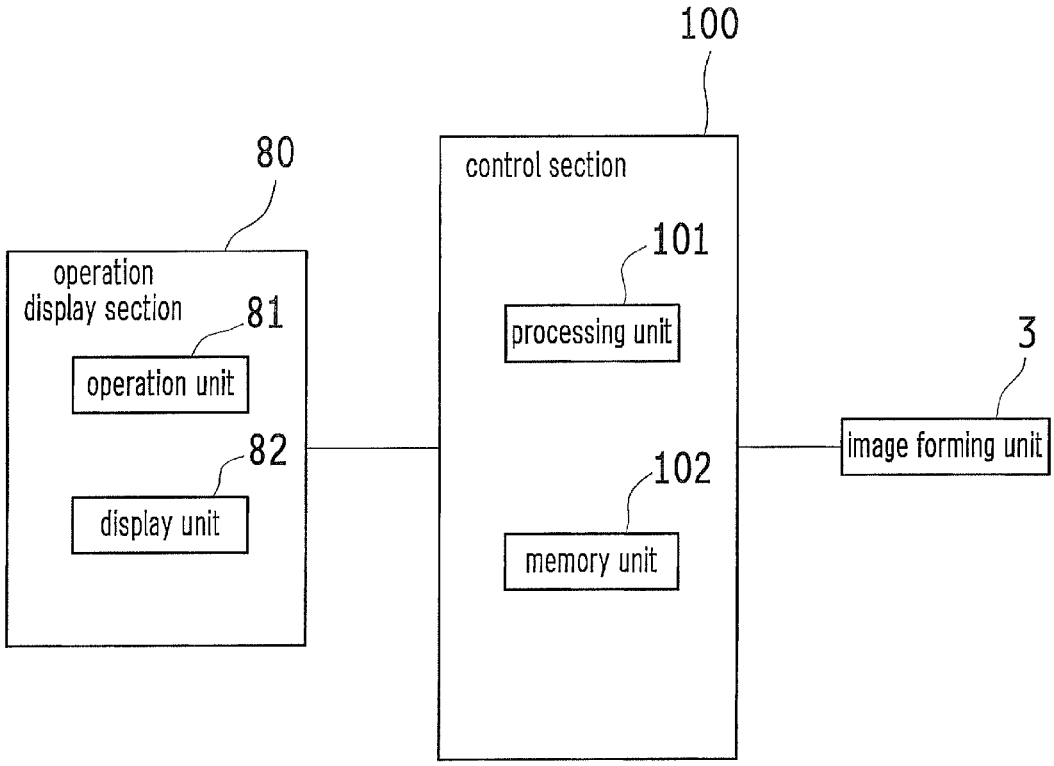
FIG. 2 is a block diagram regarding the image forming apparatus shown in FIG. 1, showing a control section at the center of the diagram.

During an adjustment process in the image forming apparatus 1, a set of adjustment pattern images PT is formed on a recording sheet P by the image forming unit 3, based on the data on the set of adjustment pattern images PT (see FIG. 3 and FIG. 4) which is stored in advance in the memory unit 102 (see FIG. 2). The set of adjustment pattern images PT includes first adjustment pattern images PT1 and second adjustment pattern images PT2 to be formed on the first side P1 and the second side P2 of the recording sheet P, respectively. Then, the recording sheet P is discharged to the discharge tray 13, with the set of adjustment pattern images PT being formed thereon. In this context, the adjustment process means a process for adjusting the position of an image formed by the image forming unit 3 in the image forming apparatus 1, such that the image forming position of the first adjustment pattern images PT1 formed on the first side P1 of the recording sheet P is aligned with the image forming position of the second adjustment pattern images PT2 formed on the second side P2 of the recording sheet P. The adjustment process will be detailed later.

(Control Unit)

FIG. 2 is a block diagram regarding the image forming apparatus 1 shown in FIG. 1, showing a control section 100 at the center of the diagram.

As shown in FIG. 2, the image forming apparatus 1 further includes a control section 100. The control section 100 is provided with a processing unit 101 such as a CPU (Central Processing Unit), and a memory unit 102 including a memory such as a ROM (Read Only Memory) and a RAM (Random Access Memory). Specifically, the image forming apparatus 1 controls various elements by allowing the processing unit 101 of the control section 100 to load and run a control program stored in advance in the ROM of the memory unit 102 on the RAM of the memory unit 102. As already stated, the data on the set of adjustment pattern images PT (see FIG. 3 and FIG. 4) is stored in advance in the ROM of the memory unit 102.

The image forming unit 3 is electrically connected to the control section 100, and is controlled by a command signal from the control section 100.

The image forming apparatus 1 is further provided with an operation display section 80 (see FIG. 7 to be described later) on which various functions and operation modes (for example, the image adjustment mode to be described later) for image formation processes can be set.

The operation display section 80 includes an operation unit 81 for performing command operations for various processes or performing input operations or selection operations for various kinds of process information, and a display unit 82 for displaying various kinds of process information in response to the command operations, input operations or selection operations.

The operation unit 81, which receives an input operation by a user, is electrically connected to an input system of the control section 100. Owing to this configuration, the operation unit 81 can receive an input operation or a selection operation on an adjustment screen Gs to be described later (see FIG. 7) or a like screen, and can transmit the input information or the selection information to the control section 100. In this embodiment, the operation unit 81 has a touch input part which is provided on a display screen G of the display unit 82 (see FIG. 7) and which receives a touch input operation (screen position information) on the display screen G. In detail, the operation unit 81 includes a display panel (so-called touch panel) which is provided on the display screen G of the display unit 82 and which can be operated by a touch on the display unit 82. It should be noted that the operation unit 81 not only enables an input operation (specifically, a touch input operation) of on-screen keys 81*a* (so-called software keys) provided on and shown on the display screen G of the display unit 82, but also enables an input operation (specifically, a push input operation) of operation key 81*b* (so-called hardware keys) provided on a display section main body 80*a* (see FIG. 7) apart from the display screen G.

The display unit 82 is equipped with a display device such as a liquid crystal display, and is electrically connected to an output system of the control section 100. Owing to this configuration, the display unit 82 can display various screens including the adjustment screen Gs (see FIG. 7), based on the screen data sent from the control section 100.

(Adjustment Pattern Image According to the First Embodiment)

Next, referring to FIG. 3 to FIG. 6, description is made of a set of adjustment pattern images PT formed on a recording sheet P by the image forming apparatus 1 shown in FIG. 1.

Figure 3:
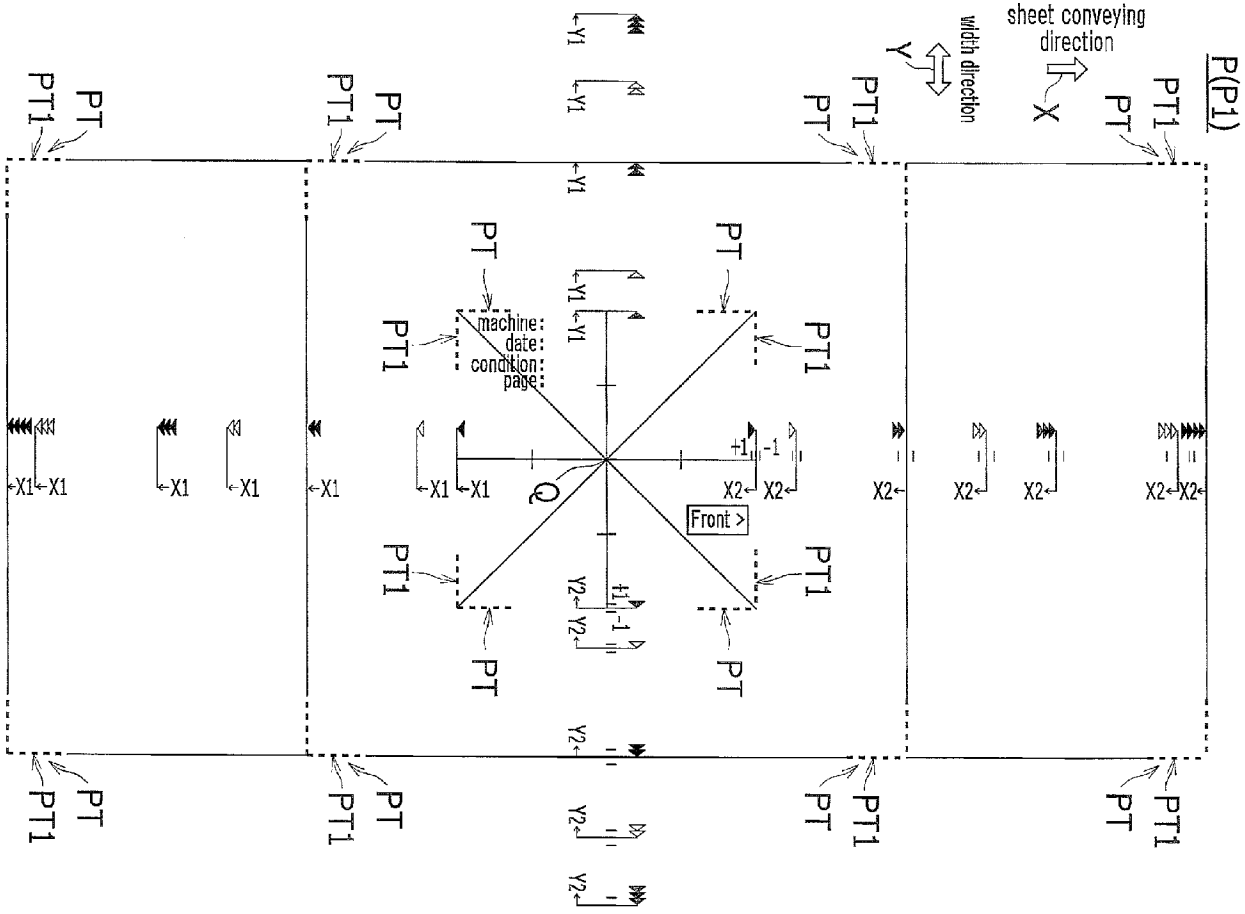
FIG. 3 is a schematic plan view showing an example of a set of adjustment pattern images, specifically showing first adjustment pattern images formed on the first side of a recording sheet.
Figure 4:
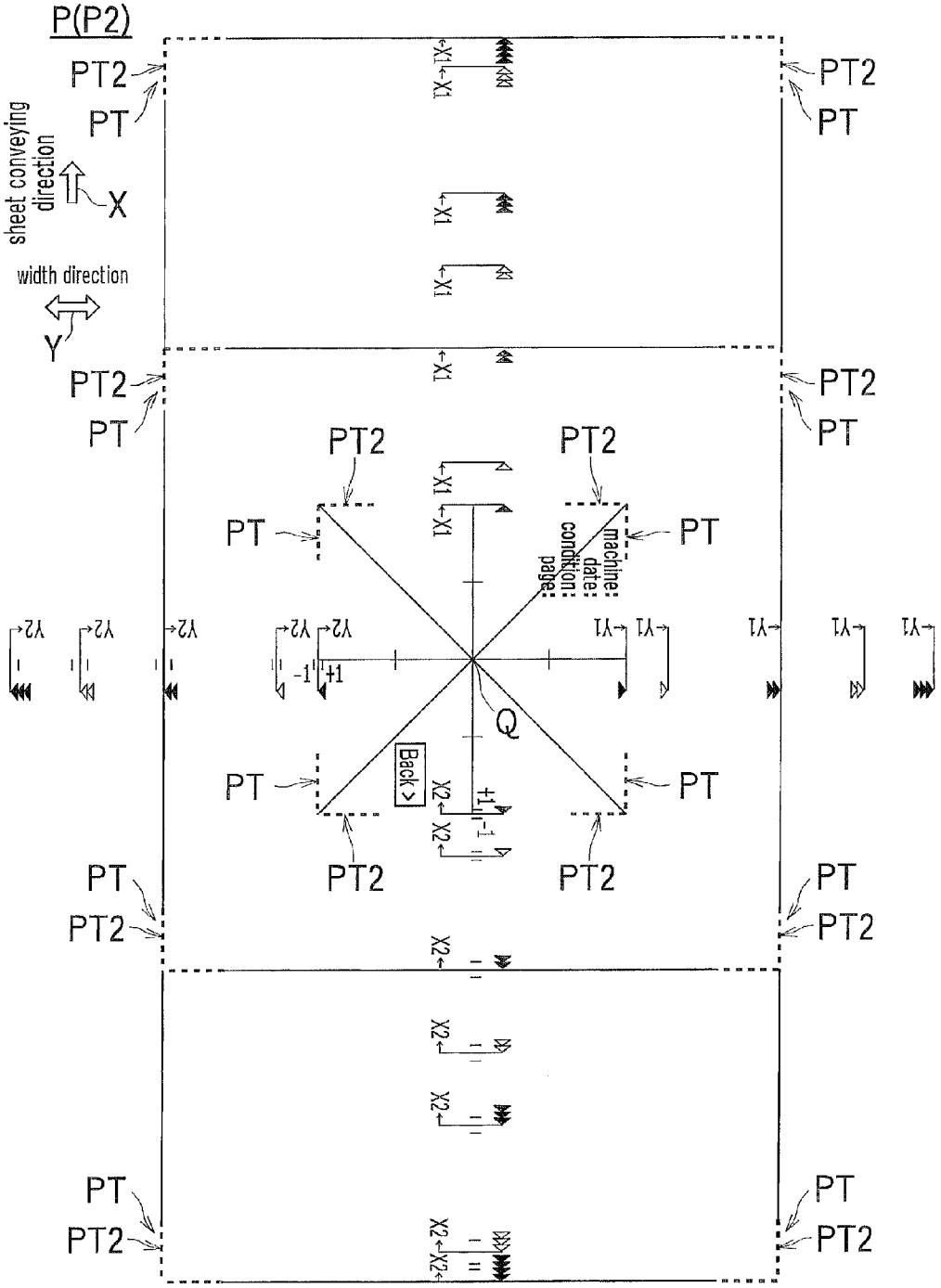
FIG. 4 is a schematic plan view showing an example of a set of adjustment pattern images, specifically showing second adjustment pattern images formed on the second side of a recording sheet.

FIG. 3 and FIG. 4 are schematic plan views showing an example of a set of adjustment pattern images PT. FIG. 3 shows first adjustment pattern images PT1 formed on the first side P1 of the recording sheet P. FIG. 4 shows second adjustment pattern images PT2 formed on the second side P2 of the recording sheet P.

The image forming apparatus 1 forms a set of adjustment pattern images PT on a recording sheet P in the image forming unit 3, under the command of the control section 100. In this context, the recording sheet P is a light-permeable recording sheet. The recording sheet P may be any type of sheet as long as it can transmit light and an image on the far side of the sheet can be seen through. For example, the recording sheet P may be a sheet of plain paper, a sheet of translucent paper, or a viewgraph, each having a thickness conforming to a predetermined standard.

In detail, the image forming apparatus 1 has an adjustment pattern image output mode for forming a set of adjustment pattern images PT on the recording sheet P, wherein first adjustment pattern images PT1 and second adjustment pattern images PT2 are formed on the first side P1 and the second side P2 of the recording sheet P, respectively, by means of the image forming unit 3 and the reverse conveyance path Sr.

Specifically, when the image forming apparatus 1 forms a set of adjustment pattern images PT on a recording sheet P, a recording sheet P in the paper feed tray 12*a* or the manual feed tray 12*b* is drawn out by the pick-up roller 14*a* or 14*i* and fed into the sheet conveyance path S. The recording sheet P is conveyed via the conveyance rollers 14*d*, the pair of pre-registration rollers 14*e*, and the pair of registration rollers 14*f*, to the transfer nip region between the intermediate transfer belt 9*e* and the transfer roller 10*a*.

At this time, out of the set of adjustment pattern images PT read out from the ROM of the memory unit 102, the first adjustment pattern images PT1 are formed on the intermediate transfer belt 9*e*, and are transferred from the intermediate transfer belt 9*e* onto the first side P1 of the recording sheet P which is conveyed from the pair of registration rollers 14*f* in the sheet conveying direction X. The transferred first adjustment pattern images PT1 are thermally fixed in the fixing device 11, and then the recording sheet P is conveyed to the discharge rollers 14*g*.

Next, while the recording sheet P is conveyed by the discharge rollers 14*g*, when the upstream end (the trailing end) in the sheet conveying direction X of the recording sheet P passes a branch point between the sheet conveyance path S and the reverse conveyance path Sr, the recording sheet P is conveyed backwardly into the reverse conveyance path Sr, then conveyed via the conveyance rollers 14*h*, the pair of pre-registration rollers 14*e*, and the pair of registration rollers 14*f*, and again guided into the transfer nip region between the intermediate transfer belt 9*e* and the transfer roller 10*a*.

At this time, out of the set of adjustment pattern images PT read out from the ROM of the memory unit 102, the second adjustment pattern images PT2 are formed on the intermediate transfer belt 9*e*, and are transferred from the intermediate transfer belt 9*e* onto the second side P2 of the recording sheet P which is conveyed from the pair of registration rollers 14*f* in the sheet conveying direction X. The transferred second adjustment pattern images PT2 are thermally fixed in the fixing device 11, and then the recording sheet P is discharged to the discharge tray 13.

In this manner, the image forming apparatus 1 can form the set of adjustment pattern images PT including the first adjustment pattern images PT1 and the second adjustment pattern images PT2 shown in FIG. 3 and FIG. 4 on the first side P1 and the second side P2 of the recording sheet P, respectively.

Figure 5:
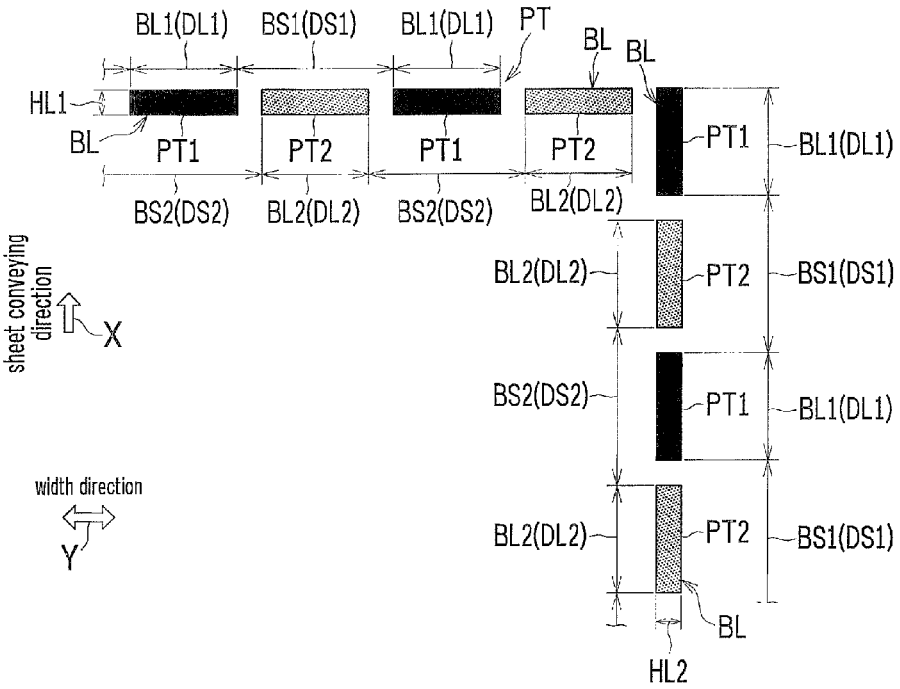
FIG. 5 is a partial enlarged plan view of the set of adjustment pattern images shown in FIG. 3 and FIG. 4, as seen through from the first side to the second side of the recording sheet. In this drawing, the image forming position of the first adjustment pattern images formed on the first side of the recording sheet is aligned with the image forming position of the second adjustment pattern images formed on the second side of the recording sheet, both in a sheet conveying direction and in a width direction.
Figure 6:
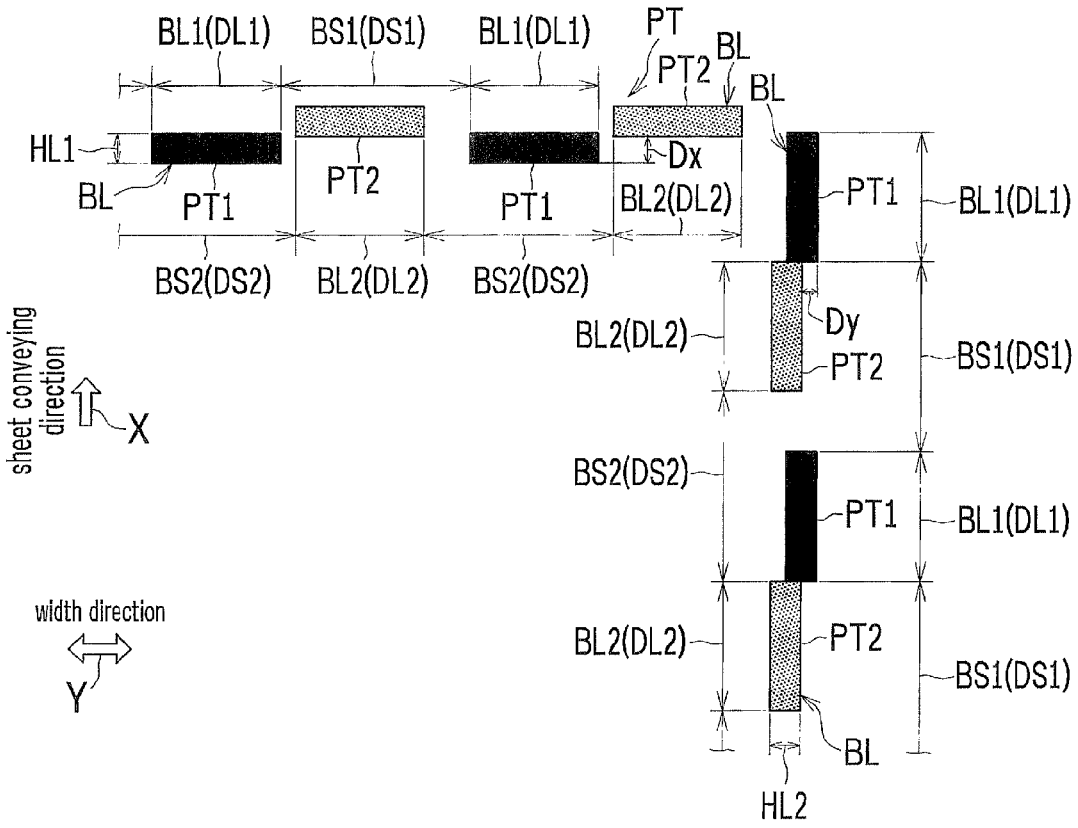
FIG. 6 is a partial enlarged plan view of the set of adjustment pattern images shown in FIG. 3 and FIG. 4, as seen through from the first side to the second side of the recording sheet. In this drawing, the image forming position of the first adjustment pattern images formed on the first side of the recording sheet is out of alignment from the image forming position of the second adjustment pattern images formed on the second side of the recording sheet, both in a sheet conveying direction and in a width direction Y.

FIG. 5 and FIG. 6 are partial enlarged plan views of the set of adjustment pattern images PT shown in FIG. 3 and FIG. 4, as seen through from the first side P1 to the second side P2 of the recording sheet P. In FIG. 5, the image forming position of the first adjustment pattern images PT1 formed on the first side P1 of the recording sheet P is aligned with the image forming position of the second adjustment pattern images PT2 formed on the second side P2 of the recording sheet P, both in the sheet conveying direction X and in the width direction Y. In FIG. 6, the image forming position of the first adjustment pattern images PT1 formed on the first side P1 of the recording sheet P is out of alignment from the image forming position of the second adjustment pattern images PT2 formed on the second side P2 of the recording sheet P, both in the sheet conveying direction X and in the width direction Y. In FIG. 5 and FIG. 6, the second adjustment pattern images PT2, formed on the second side P2 and seen through the recording sheet, are illustrated in halftone.

As shown in FIG. 5 and FIG. 6, the set of adjustment pattern images PT includes at least two first adjustment pattern images PT1 that are spaced from each other and at least two second adjustment pattern images that are spaced from each other.

In the state where the image forming positions of the first adjustment pattern images PT1 and the second adjustment pattern images PT2 are aligned, the first adjustment pattern images PT1 on the first side P1 and the second adjustment pattern images PT2 on the second side P2 appear alternately with each other. In the present embodiment, the first adjustment pattern images PT1 and the second adjustment pattern images PT2 are arranged in a broken linear pattern.

Specifically, the first adjustment pattern images PT1 and the second adjustment pattern images PT2 are arranged as broken straight lines BL, BL made of a plurality of dots or lines (in this example, lines BL1-BL1 as the first adjustment pattern images PT1, and lines BL2-BL2 as the second adjustment pattern images PT2). In other words, the first adjustment pattern images PT1 and the second adjustment pattern images PT2 have intervals BS1-BS1, BS2-BS2, respectively, between adjacent dots or lines (in this example, between adjacent lines BL1, BL1 and between adjacent lines BL2, BL2).

More specifically, the dots or lines in the first adjustment pattern images PT1 (in this example, the lines BL1-BL1) are located at the intervals BS2-BS2 between the second adjustment pattern images PT2, and the dots or lines in the second adjustment pattern images PT2 (in this example, the lines BL2-BL2) are located at the intervals BS1-BS1 between the first adjustment pattern images PT1. Additionally, the first adjustment pattern images PT1-PT1 and the corresponding second adjustment pattern images PT2-PT2 are parallel to each other.

The first adjustment pattern images PT1 are separated from each other by a predetermined distance DS1, and the second adjustment pattern images PT2 are separated from each other by a predetermined distance DS2.

Specifically, the lines BL1 as the first adjustment pattern images PT1 have a predetermined length DL1 and width HL1, and the interval between adjacent lines BL1, BL1 is a predetermined distance DS1. The lines BL2 as the second adjustment pattern images PT2 have a predetermined length DL2 and width HL2, and the interval between adjacent lines BL2, BL2 is a predetermined distance DS2. The predetermined lengths DL1 and DL2 may be the same or different. In this example, the predetermined lengths DL1 and DL2 are 2 mm each. The predetermined widths HL1 and HL2 may be the same or different. In this example, the predetermined widths HL1 and HL2 are 0.5 mm each. The predetermined distances DS1 and DS2 may be the same or different. In this example, the predetermined distances DS1 and DS2 are 3 mm each.

Referring next to the example shown in FIG. 6, the first adjustment pattern images PT1 and the second adjustment pattern images PT2 are out of alignment by a misalignment amount Dx in the sheet conveying direction X, and by a misalignment amount Dy in the width direction Y.

In this example, the set of adjustment pattern images PT formed by the image forming apparatus 1 includes at least two first adjustment pattern images PT1 and at least two second adjustment pattern images PT2 in the sheet conveying direction X of the recording sheet P, and at least two first adjustment pattern images PT1 and at least two second adjustment pattern images PT2 in the width direction Y orthogonal to the sheet conveying direction X.

Specifically, the first adjustment pattern images PT1 and the second adjustment pattern images PT2 constitute the whole or a part (side(s) and/or corner(s)) of a quadrangular figure having a predetermined size. In this example, the first adjustment pattern images PT1 and the second adjustment pattern images PT2 constitute the four corners of a 10-mm-side square-shaped figure.

The first adjustment pattern images PT1 and the second adjustment pattern images PT2 are identical to each other, with either the former or the latter being rotated 180 degrees about the center Q of the recording sheet P in plan view (see FIG. 3 and FIG. 4). Namely, the first adjustment pattern images PT1 are identical to the second adjustment pattern images PT2, with the latter being rotated 180 degrees about the center Q of the recording sheet P in plan view, and the second adjustment pattern images PT2 are identical to the first adjustment pattern images PT1, with the latter being rotated 180 degrees about the center Q of the recording sheet P in plan view.

The first adjustment pattern images PT1 and the second adjustment pattern images PT2 are formed in different colors from each other (for example, in complementary colors opposed in the color circle, or in colors neighboring the complementary colors).

As shown in FIG. 3, on the first side P1 of the recording sheet P on which the first adjustment pattern images PT1 are formed, there are also formed measurement images X1 for measuring a distance from the upstream end (the trailing end) in the sheet conveying direction X with a ruler, and measurement images X2 for measuring a distance from the downstream end (the leading end) in the sheet conveying direction X with a ruler. In this example, the measurement images X1, X2 are paired and marked with corresponding triangle marks (black triangles and white triangles) in order to enable measurement suitable for the size of the recording sheet P. As shown in FIG. 3, on the first side P1 of the recording sheet P on which the first adjustment pattern images PT1 are formed, there are further formed measurement images Y1 for measuring a distance from an end (the left end) in the width direction with a ruler, and measurement images Y2 for measuring a distance from the other end (the right end) in the width direction with a ruler. In this example, the measurement images Y1, Y2 are paired and marked with corresponding triangle marks (black triangles and white triangles) in order to enable measurement suitable for the size of the recording sheet P.

As shown in FIG. 4, on the second side P2 of the recording sheet P on which the second adjustment pattern images PT2 are formed, there are also formed measurement images X1 for measuring a distance from the downstream end (the leading end) in the sheet conveying direction X with a ruler, and measurement images X2 for measuring a distance from the upstream end (the trailing end) in the sheet conveying direction X with a ruler. In this example, the measurement images X1, X2 are paired and marked with corresponding triangle marks (black triangles and white triangles) in order to enable measurement suitable for the size of the recording sheet P. As shown in FIG. 4, on the second side P2 of the recording sheet P on which the second adjustment pattern images PT2 are formed, there are further formed measurement images Y1 for measuring a distance from the other end (the right end) in the width direction with a ruler, and measurement images Y2 for measuring a distance from the one end (the left end) in the width direction with a ruler. In this example, the measurement images Y1, Y2 are paired and marked with corresponding triangle marks (black triangles and white triangles) in order to enable measurement suitable for the size of the recording sheet P.

(Adjustment Process)

Figure 7:
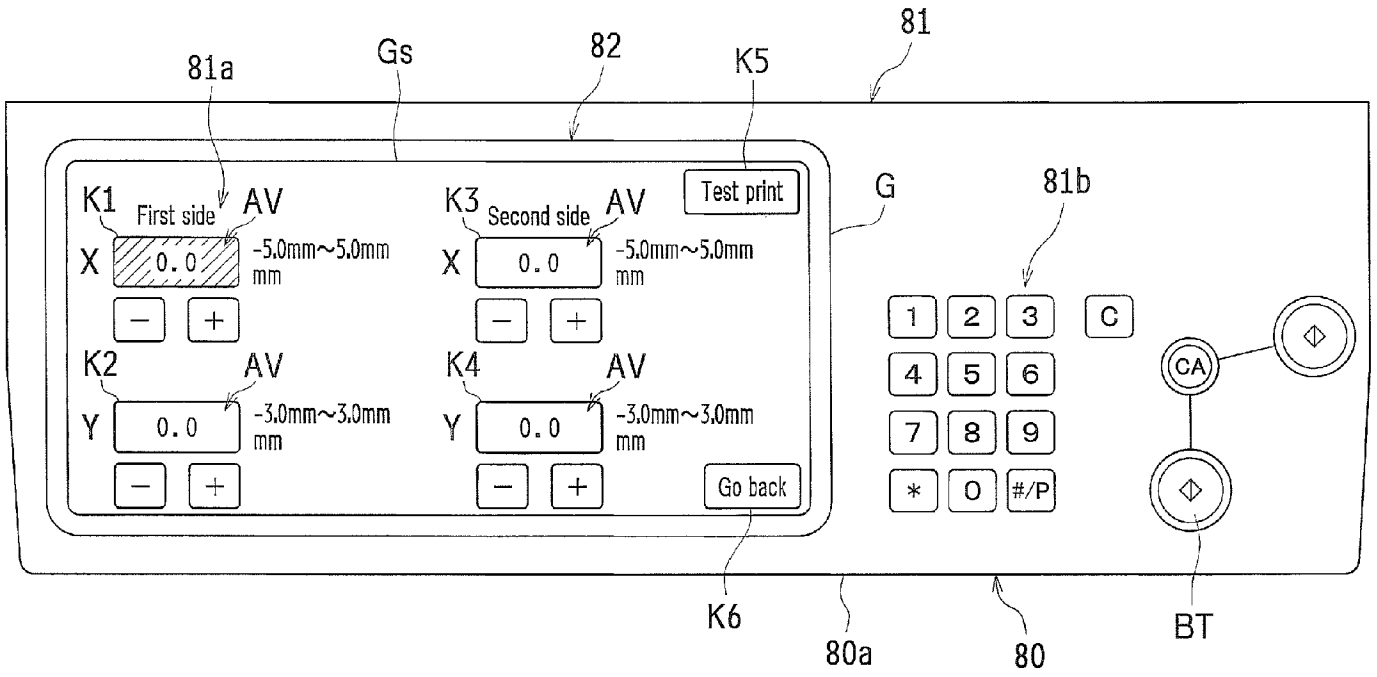
FIG. 7 is a schematic plan view of an operation display section in an image adjustment mode, wherein an adjustment screen for adjusting image forming positions of duplex images is displayed on a display screen of a display unit.

Next, referring to FIG. 7, description is made of an adjustment process in an image adjustment mode for adjusting the set of adjustment pattern images PT shown in FIG. 3 and FIG. 4. For an image adjustment process in the image forming apparatus 1, it is possible to employ a detection device provided in the image forming apparatus 1 (for example, a detection device, not shown, composed of an image reading sensor and adopting a detection control configuration in the control section 100). With light being projected through the recording sheet P on which the first adjustment pattern images PT1 and the second adjustment pattern images PT2 are formed, the detection device may detect from either the first side P1 or the second side P2 whether the first and second adjustment pattern images PT1, PT2 are aligned, may calculate an adjustment value AV, and may input the adjustment value AV into the control section 100. However, it should be understood that the image adjustment process in the following description is done by an operator. Namely, an operator such as a serviceman and a user sees through the recording sheet P on which the first adjustment pattern images PT1 and the second adjustment pattern images PT2 are formed, from either the first side P1 or the second side P2 (in this example, from the first side P1), with the recording sheet P being held to the light. In this state, the operator visually checks how much the first adjustment pattern images PT1 on the first side P1 and the second adjustment pattern images PT2 on the second side P2 are out of alignment from each other, obtains an adjustment value AV, and inputs the adjustment value AV in the operation unit 81.

The image forming apparatus 1 has an image adjustment mode in which the image forming apparatus 1 receives an adjustment value AV inputted in the operation unit 81 and writes an image based on this adjustment value AV, so that an image can be formed on the recording sheet P at a position corresponding to the adjustment value AV.

FIG. 7 is a schematic plan view of an operation display section 80 in an image adjustment mode, wherein an adjustment screen Gs for adjusting image forming positions of duplex images is displayed on a display screen G of a display unit 82.

In the image forming apparatus 1 according to this embodiment, a first input display part K1 receives an input of a misalignment adjustment value AV in the sheet conveying direction X on the first side P1 of the recording sheet P. A second input display part K2 receives an input of a misalignment adjustment value AV in the width direction Y on the first side P1 of the recording sheet P. A third input display part K3 receives an input of a misalignment adjustment value AV in the sheet conveying direction X on the second side P2 of the recording sheet P. A fourth input display part K4 receives an input of a misalignment adjustment value AV in the width direction Y on the second side P2 of the recording sheet P. When an operator touches to select any of these input display parts, the characters and background in the selected input display part are highlighted. FIG. 7 shows a state where the misalignment adjustment value AV in the sheet conveying direction X on the first side P1 is selected (see the hatched area). In this embodiment, the default value of the adjustment values AV is 0.0 mm.

In the image forming apparatus 1, when the first input display part K1 and the third input display part K3 are selected, the adjustment values AV can be increased up to 5.0 mm with 0.1 mm increments by an operator's touch operation on the plus key "+", and can be decreased down to −5.0 mm with 0.1 mm decrements by an operator's touch operation on the minus key "−". When the second input display part K2 and the fourth input display part K4 are selected, the adjustment values AV can be increased up to 3.0 mm with 0.1 mm increments by an operator's touch operation on the plus key "+", and can be decreased down to −3.0 mm with 0.1 mm decrements by an operator's touch operation on the minus key "−". In the image forming apparatus 1, the adjustment values AV can be changed by the plus key "+" and the minus key "−", and also can be directly inputted by the numerical keypad of the operation keys 81*b*.

In the adjustment process, an operator sees through the first adjustment pattern images PT1 and the second adjustment pattern images PT2 shown in FIG. 3 and FIG. 4 from the first side P1 to the second side P2 of the recording sheet P. If the operator finds that the first adjustment pattern images PT1 and the second adjustment pattern images PT2 are out of alignment, the operator performs following adjustment steps.

If the operator finds that the first adjustment pattern images PT1 and the second adjustment pattern images PT2 are out of alignment in the sheet conveying direction X, the operator inputs adjustment values AV on the first input display part K1 and the third input display part K3. The adjustment value AV to be inputted on the first input display part K1 is represented as [(AX1−AX2)/2], wherein AX1 is a value from the upstream end (the trailing end) in the sheet conveying direction to a measurement image X1 on the first side P1 of the recording sheet P, AX2 is a value from the downstream end (the leading end) in the sheet conveying direction to a measurement image X2 on the first side P1 of the recording sheet P, AX2 is subtracted from AX1, and the difference is divided by two. The adjustment value AV to be inputted on the third input display part K3 is represented as [(AX1−AX2)/2], wherein AX1 is a value from the downstream end (the leading end) in the sheet conveying direction to a measurement image X1 on the second side P2 of the recording sheet P, AX2 is a value from the upstream end (the trailing end) in the sheet conveying direction to a measurement image X2 on the second side P2 of the recording sheet P, AX2 is subtracted from AX1, and the difference is divided by two. Based on the entered adjustment values AV, the control section 100 can decide a writing timing of an image (an electrostatic latent image) in the sheet conveying direction X (the sub-scanning direction) in the exposure device 6 of the image forming unit 3.

If the operator finds that the first adjustment pattern images PT1 and the second adjustment pattern images PT2 are out of alignment in the width direction Y, the operator inputs adjustment values AV on the second input display part K2 and the fourth input display part K4. The adjustment value AV to be inputted on the second input display part K2 is represented as [(AY1−AY2)/2], wherein AY1 is a value from one end (the left end) in the width direction to a measurement image Y1 on the first side P1 of the recording sheet P, AY2 is a value from the other end (the right end) in the width direction to a measurement image Y2 on the first side P1 of the recording sheet P, AY2 is subtracted from AY1, and the difference is divided by two. The adjustment value AV to be inputted on the fourth input display part K4 is represented as [(AY1−AY2)/2], wherein AY1 is a value from the other end (the right end) in the width direction to a measurement image Y1 on the second side P2 of the recording sheet P, AY2 is a value from the one end (the left end) in the width direction to a measurement image Y2 on the second side P2 of the recording sheet P, AY2 is subtracted from AY1, and the difference is divided by two. Based on the entered adjustment values AV, the control section 100 can decide a writing timing of an image (an electrostatic latent image) in the width direction Y (the main-scanning direction) in the exposure device 6 of the image forming unit 3.

Next, the operator touches a test print key K5 to operate the adjustment pattern image output mode, thereby causing the image forming apparatus 1 to form a set of adjustment pattern images PT on a recording sheet.

Then again, the operator sees through the first adjustment pattern images PT1 and the second adjustment pattern images PT2 shown in FIG. 3 and FIG. 4 from the first side P1 to the second side P2 of the recording sheet P. If the operator still finds that the first adjustment pattern images PT1 and the second adjustment pattern images PT2 are out of alignment, the operator performs the above adjustment steps.

The operator repeats the series of adjustment steps until the first adjustment pattern images PT1 and the second adjustment pattern images PT2 are aligned.

Finally, when the operator finds that the first adjustment pattern images PT1 and the second adjustment pattern images PT2 are aligned, the operator touches a back key K6 to go back to the previous screen and ends the adjustment process.

(Remarks on the First Embodiment)

As described above, the set of adjustment pattern images according to the first embodiment includes at least two first adjustment pattern images PT1 that are spaced from each other on the first side P1 of the recording sheet P and at least two second adjustment pattern images that are spaced from each other on the second side P2 of the recording sheet P, and the first adjustment pattern images PT1 and the second adjustment pattern images PT2 are arranged alternately with each other on the first side P1 and the second side P2. This arrangement helps an operator to find even a slight misalignment between the first adjustment pattern images PT1 and the second adjustment pattern images PT2. Eventually, an operator can precisely find out, or a detection device can precisely detect, a slight misalignment between the first adjustment pattern images PT1 on the first side P1 and the second adjustment pattern images PT2 on the second side P2.

In the first embodiment, the first adjustment pattern images PT1 and the second adjustment pattern images PT2 are arranged in a broken linear pattern. The broken linear pattern helps visual intelligibility for the operator or detectability for the detection device in recognizing the first adjustment pattern images PT1 and the second adjustment pattern images PT2. As a result, the operator or the detection device can recognize a misalignment between the first adjustment pattern images PT1 and the second adjustment pattern images PT2 more easily.

In the first embodiment, the first adjustment pattern images PT1 and the second adjustment pattern images PT2 are arranged as broken straight lines made of a plurality of dots or lines (in this example, lines BL1-BL1 as the first adjustment pattern images PT1, and lines BL2-BL2 as the second adjustment pattern images PT2). In the first adjustment pattern images PT1 and the second adjustment pattern images PT2 arranged in a broken linear pattern, the dots or lines (in this example, the lines BL1-BL1, BL2-BL2) can be readily seen by the operator or recognized by the detection device owing to the intervals BS1-BS1, BS2-BS2. As a result, the operator or the detection device can recognize a misalignment between the first adjustment pattern images PT1 and the second adjustment pattern images PT2 more easily.

In the first embodiment, the lines BL1, BL2 in the first adjustment pattern images PT1 and the second adjustment pattern images PT2 are separated by predetermined distances DS1, DS2, respectively. Owing to this arrangement, the first adjustment pattern images PT1 and the second adjustment pattern images PT2 can be positioned at the same cycle, thereby allowing the operator to find out or allowing the detection device to detect a misalignment between the first adjustment pattern images PT1 and the second adjustment pattern images PT2 with good visual intelligibility. As a result, the operator or the detection device can recognize a misalignment between the first adjustment pattern images PT1 and the second adjustment pattern images PT2 more easily.

In the first embodiment, the set of adjustment pattern images PT formed by the image forming apparatus 1 includes at least two first adjustment pattern images PT1 and at least two second adjustment pattern images PT2 in the sheet conveying direction X of the recording sheet P, and at least two first adjustment pattern images PT1 and at least two second adjustment pattern images PT2 in the width direction Y orthogonal to the sheet conveying direction X. As a result, the operator can find out or the detection device can detect a misalignment between the first adjustment pattern images PT1 and the second adjustment pattern images PT2 not only in the sheet conveying direction X but also in the width direction Y.

In the first embodiment, the first adjustment pattern images PT1 and the second adjustment pattern images PT2 constitute the whole or a part of a quadrangular figure having a predetermined size. As a result, the operator can easily find out or the detection device can easily detect a misalignment between the first adjustment pattern images PT1 and the second adjustment pattern images PT2, at any of the four sides of the quadrangular shape.

In the first embodiment, the first adjustment pattern images PT1 and the second adjustment pattern images PT2 are identical to each other, with either the former or the latter being rotated 180 degrees about the center Q of the recording sheet P in plan view (see FIG. 3 and FIG. 4). In terms of control configuration, the same adjustment pattern image can be used as the first adjustment pattern images PT1 and the second adjustment pattern images PT2, thereby decreasing the amount of image data.

In the first embodiment, the first adjustment pattern images PT1 and the second adjustment pattern images PT2 are formed in different colors from each other (for example, in complementary colors opposed in the color circle, or in colors neighboring the complementary colors). The color contrast allows the operator to find out, or allows the detection device to detect, a misalignment between the first adjustment pattern images PT1 and the second adjustment pattern images PT2 with good visual intelligibility. As a result, the operator or the detection device can recognize a misalignment between the first adjustment pattern images PT1 and the second adjustment pattern images PT2 more easily.

(Adjustment Pattern Image According to the Second Embodiment)

Figure 8:
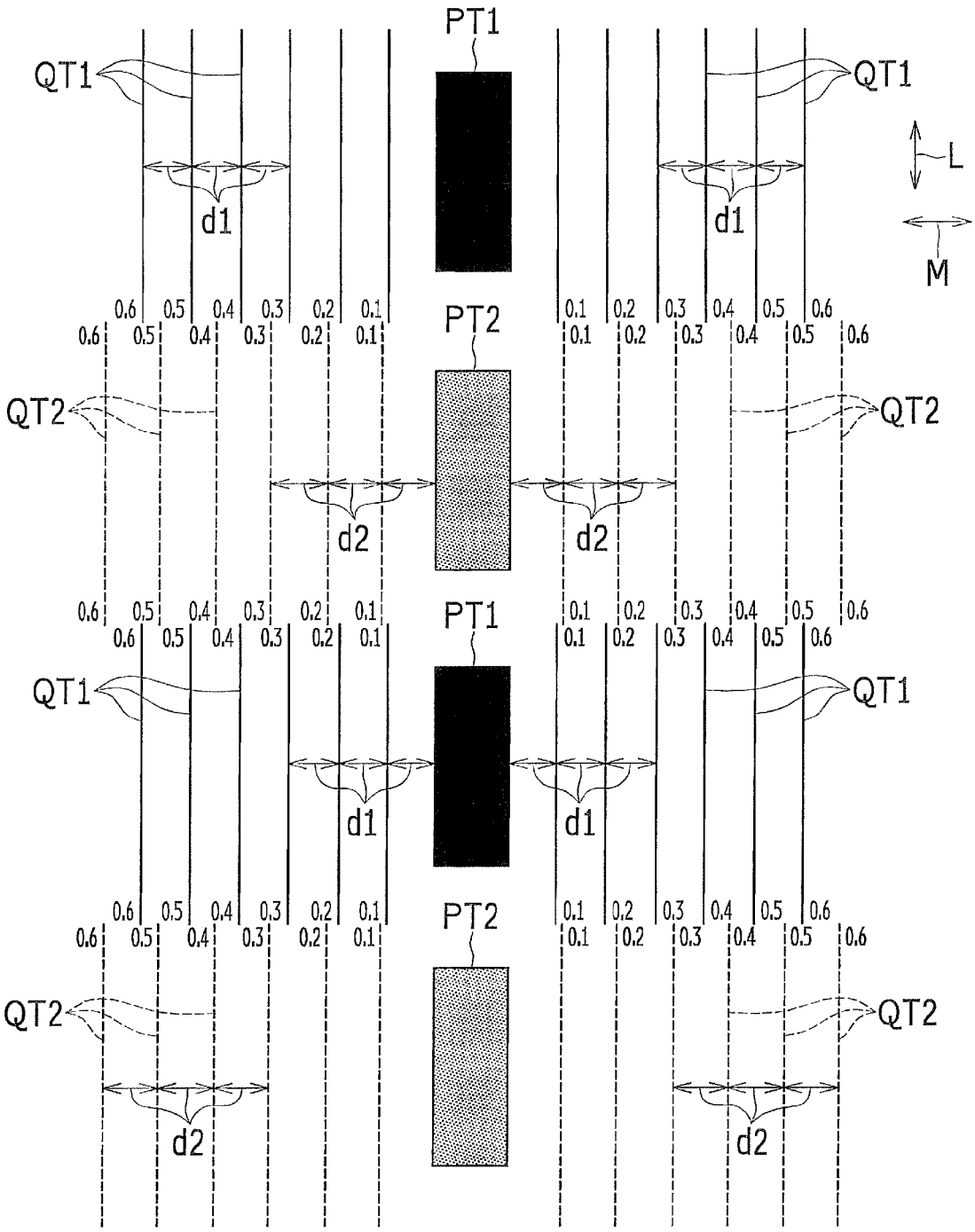
FIG. 8 is an enlarged plan view of another example of a set of adjustment pattern images, as seen through from the first side to the second side of the recording sheet.
Figure 9A:
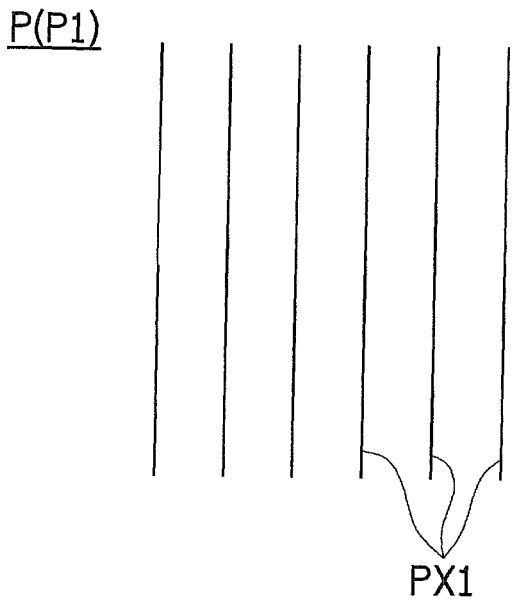
FIG.9(a) Prior Art
FIG. 9(*a*) is a plan view showing an example of a set of conventional adjustment pattern images as disclosed in Patent Document 1, specifically showing adjustment pattern images formed on one side (a first side) of a recording sheet.
Figure 9B:
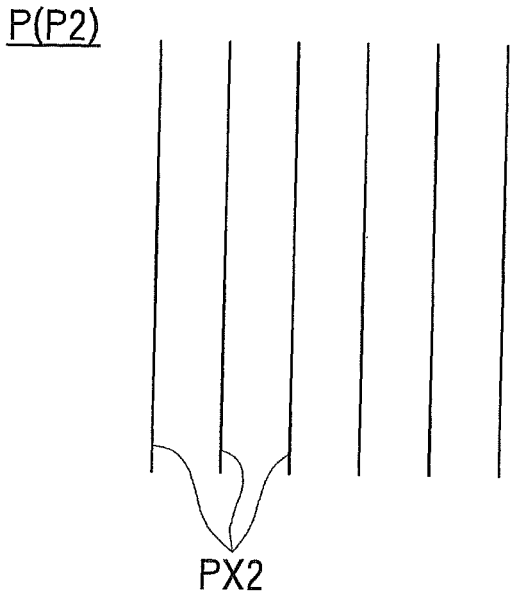
FIG.9(b) Prior Art

Next, referring to FIG. 8, description is made of another example of the set of adjustment pattern images PT shown in FIG. 3 and FIG. 4.

FIG. 8 is an enlarged plan view of another example of a set of adjustment pattern images PT, as seen through from the first side P1 to the second side P2 of the recording sheet P. In FIG. 8, the second adjustment pattern images PT2, formed on the second side P2 and seen through the recording sheet, are illustrated in halftone, and the second measurement images QT2, formed on the second side P2 and seen through the recording sheet, are illustrated by dashed lines. FIG. 8 shows the state where the first adjustment pattern images PT1-PT1 are not misaligned from the second adjustment pattern images PT2-PT2.

In the set of adjustment pattern images PT shown in FIG. 8, first measurement images QT1-QT1 are formed on each side of either the first adjustment pattern images PT1-PT1 or the second adjustment pattern images PT2-PT2 (in this example, on each side of the first adjustment pattern images PT1-PT1). The first measurement images QT1-QT1 are spaced from each other in an orthogonal direction M that is orthogonal to a straight line direction L, by predetermined intervals d1-d1 (in this example, 1 mm) with reference to the associated adjustment pattern images (in this example, the first adjustment pattern images PT1-PT1). Second measurement images QT2-QT2 are formed on each side of the first or second adjustment pattern images PT1-PT1 or PT2-PT2 along which the first measurement images QT1-QT1 are not formed (in this example, on each side of the second adjustment pattern images PT2-PT2). The second measurement images QT2-QT2 are spaced from each other in the orthogonal direction M, by intervals d2-d2 (in this example, 1.1 mm) with reference to the other associated adjustment pattern images (in this example, the second adjustment pattern images PT2-PT2). The intervals d2-d2 are obtained by adding a predetermined value (in this example, 0.1 mm) to the predetermined intervals d1-d1 (in this example, 1 mm) The first measurement images QT1-QT1 are parallel to the first adjustment pattern images PT1-PT1, and the second measurement images QT2-QT2 are parallel to the second adjustment pattern images PT2-PT2. The first measurement images QT1-QT1 are formed in a straight line shape, parallel to each other along the first adjustment pattern images PT1. The second measurement images QT2-QT2 are formed in a straight line shape, parallel to each other along the second adjustment pattern images PT2. The predetermined intervals d1-d1 may be a fixed value or may be changed between each other.

In the state where either the first adjustment pattern images PT1 or the second adjustment pattern images PT2 (for example, the first adjustment pattern images PT1) have been measured with a ruler and the image forming position has been adjusted, the amount of misalignment in the other unadjusted adjustment pattern images (for example, the second adjustment pattern images PT2) can be obtained by finding the position at which the unadjusted adjustment pattern images (for example, the second adjustment pattern images PT2) are aligned with the adjusted adjustment pattern images (for example, the first adjustment pattern images PT1).

For example, if the first measurement images QT1 third to the right of the first adjustment pattern images PT1-PT1 are aligned with the second measurement images QT2 third to the right of the second adjustment pattern images PT2-PT2, then the second adjustment pattern images PT2-PT2 are out of alignment to the left from the first adjustment pattern images PT1-PT1 by 0.3 mm. If the first measurement images QT1 fourth to the left of the first adjustment pattern images PT1-PT1 are aligned with the second measurement images QT2 fourth to the left of the second adjustment pattern images PT2-PT2, then the second adjustment pattern images PT2-PT2 are out of alignment to the right from the first adjustment pattern images PT1-PT1 by 0.4 mm.

According to this embodiment, either of the first measurement images QT1 or the second measurement images QT2 (for example, the second measurement images QT2 for which the image forming position has not been adjusted) can be adjusted without using a ruler.

In the present embodiments, in order to check whether the image forming position of the first adjustment pattern images PT1 formed on the first side P1 of the recording sheet P is aligned with the image forming position of the second adjustment pattern images PT2 formed on the second side P2 of the recording sheet P, the operator sees through the recording sheet P from the first side P1 to the second side P2. It goes without saying that the operator may see through the recording sheet P from the second side P2 to the first side P1.

It should be also understood that the present embodiments are not only applicable in centimeters/millimeters as described above but also applicable in inches.

The present invention can be embodied and practiced in other different forms without being limited to the above-described embodiments. Therefore, the above-described embodiments are considered in all respects as illustrative and not restrictive. The scope of the invention is indicated by the appended claims rather than by the foregoing description. All variations and modifications falling within the equivalency range of the appended claims are intended to be embraced therein.

The invention claimed is:

1. An image forming apparatus that forms a set of adjustment pattern images on a recording sheet and adjusts an image forming position based on the set of adjustment pattern images, the set of adjustment pattern images including first adjustment pattern images to be formed on a first side of the recording sheet and second adjustment pattern images to be formed on a second side of the recording sheet, wherein the image forming apparatus comprises:

an image former configured or programmed to form an image on the recording sheet; and a memory configured or programmed to store the set of adjustment pattern images, the memory stores the set of adjustment pattern images which includes the first adjustment pattern images, the second adjustment pattern images, first measurement images, and second measurement images in such a manner as to satisfy conditions (A) and (B):

A) at least two of the first adjustment pattern images are formed and spaced from each other, and at least two of the second adjustment pattern images are formed and spaced from each other, such that closest ones of the first adjustment pattern images on the first side and the second adjustment pattern images on the second side appear alternately with each other, and such that the first adjustment pattern images and the second adjustment pattern images appear linearly; and (B) the first measurement images are positioned with reference to the first adjustment pattern images and spaced from each other in a predetermined direction by a predetermined first interval, and the second measurement images are positioned with reference to the second adjustment pattern images and spaced from each other in the predetermined direction by a predetermined second interval, the predetermined second interval being greater than the predetermined first interval by a predetermined value other than zero, and the image forming apparatus reads out the first adjustment pattern images, the second adjustment pattern images, the first measurement images, and the second measurement images from the memory, and forms, in the image former, the first adjustment pattern images and the first measurement images on the first side, and the second adjustment pattern images and the second measurement images on the second side.

2. The image forming apparatus according to claim 1, wherein the first adjustment pattern images and the second adjustment pattern images are arranged as broken straight lines including a plurality of dots or lines.

3. The image forming apparatus according to claim 2, wherein the first measurement images are formed on each side of the first adjustment pattern images, the first measurement images being spaced from each other in an orthogonal direction that is orthogonal to a direction of the broken straight lines, by the predetermined first interval with reference to the first adjustment pattern images, and wherein the second measurement images are formed on each side of the second adjustment pattern images, the second measurement images being spaced from each other in the orthogonal direction by the predetermined second interval with reference to the second adjustment pattern images, the predetermined second interval being obtained by adding the predetermined value to the predetermined first interval.

4. The image forming apparatus according to claim 1, wherein the first adjustment pattern images are separated from each other by a first predetermined distance, and the second adjustment pattern images are separated from each other by a second predetermined distance.

5. The image forming apparatus according to claim 1, wherein at least two of the first adjustment pattern images and at least two of the second adjustment pattern images are formed in a sheet conveying direction, and at least two of the first adjustment pattern images and at least two of the second adjustment pattern images are formed in a width direction of the recording sheet, the width direction being orthogonal to the sheet conveying direction.

6. The image forming apparatus according to claim 1, wherein the first adjustment pattern images and the second adjustment pattern images are identical to each other, with either the first adjustment pattern images or the second adjustment pattern images being rotated 180 degrees about a center of the recording sheet in plan view.

7. The image forming apparatus according to claim 1, wherein the first adjustment pattern images and the second adjustment pattern images are formed in different colors.

8. The image forming apparatus according to claim 1, wherein, in a state where there is no relative misalignment between images on the first side of the recording sheet and images on the second side of the recording sheet, the first adjustment pattern images and the second adjustment pattern images are arranged alternately with each other, with a space between closest ones of the first adjustment pattern images and the second adjustment pattern images.

9. The image forming apparatus according to claim 1, wherein, in a state where there is no relative misalignment between images on the first side of the recording sheet and images on the second side of the recording sheet, the first adjustment pattern images and the second adjustment pattern images are arranged alternately with each other, in an intermittent fashion.

10. An image adjustment method for an image forming apparatus which forms an image on a recording sheet by writing the image based on an adjustment value entered by an input operation input to an operation receiver or an adjustment value detected by a detection device, comprising:

an image storing step of storing a set of adjustment pattern images which includes first adjustment pattern images, second adjustment pattern images, first measurement images, and second measurement images in a memory of the image forming apparatus in such a manner as to satisfy conditions (A) and (B):

(A) at least two of the first adjustment pattern images are formed and spaced from each other on a first side of the recording sheet, and at least two of the second adjustment pattern images are formed and spaced from each other on a second side of the recording sheet, such that closest ones of the first adjustment pattern images on the first side and the second adjustment pattern images on the second side are arranged alternately with each other, and such that the first adjustment pattern images and the second adjustment pattern images appear linearly, and (B) the first measurement images are positioned with reference to the first adjustment pattern images and spaced from each other in a predetermined direction by a predetermined first interval, and the second measurement images are positioned with reference to the second adjustment pattern images and spaced from each other in the predetermined direction by a predetermined second interval, the predetermined second interval being greater than the predetermined first interval by a predetermined value other than zero;

an image forming step of reading out the first adjustment pattern images, the second adjustment pattern images, the first measurement images, and the second measurement images from the memory, and forming, in an image former of the image forming apparatus, the first adjustment pattern images and the first measurement images on the first side of the recording sheet, and the second adjustment pattern images and the second measurement images on the second side of the recording sheet;

a measurement step of measuring the first and second adjustment pattern images formed on the recording sheet in the image forming step;

an adjustment value input step of obtaining the adjustment value from the first measurement image and the second measurement image, and inputting the adjustment value by the operation receiver into the image forming apparatus, the adjustment value being a value indicating how much the first adjustment pattern images on the first side are misaligned relative to the second adjustment pattern images on the second side; and an image writing step of determining an image writing timing by the image forming apparatus, based on the adjustment value inputted in the adjustment value input step.

11. The image adjustment method according to claim 10, wherein, in a state where there is no relative misalignment between images on the first side of the recording sheet and images on the second side of the recording sheet, the first adjustment pattern images and the second adjustment pattern images are arranged alternately with each other, with a space between closest ones of the first adjustment pattern images and the second adjustment pattern images.

12. The image adjustment method according to claim 10, wherein, in a state where there is no relative misalignment between images on the first side of the recording sheet and images on the second side of the recording sheet, the first adjustment pattern images and the second adjustment pattern images are arranged alternately with each other, in an intermittent fashion.

* * * * *